US005374043A

United States Patent [19]

Mandel et al.

[11] Patent Number: 5,374,043

[45] Date of Patent: Dec. 20, 1994

[54] SORTER WITH STAPLER ACTIVED RELEASE GATE MECHANISM

[75] Inventors: Barry P. Mandel; William R. Burger, both of Fairport, N.Y.

[73] Assignee: Xerox Corporation, Stamford, Conn.

[21] Appl. No.: 129,480

[22] Filed: Sep. 30, 1993

[51] Int. Cl.[5] ..... B31B 1/68

[52] U.S. Cl. ..... 270/53

[58] Field of Search ..... 270/53; 355/324

[56] References Cited

U.S. PATENT DOCUMENTS

| | | | |
|---|---|---|---|
| 4,083,550 | 4/1978 | Pal | 270/53 |
| 4,134,581 | 1/1979 | Johnson et al. . | |
| 4,376,529 | 3/1983 | George et al. . | |
| 4,497,478 | 2/1985 | Reschenhofer et al. | 270/53 |
| 4,522,485 | 7/1985 | Kamiya et al. . | |
| 4,558,860 | 12/1985 | Stemmle . | |
| 4,605,211 | 8/1986 | Sonabe . | |
| 4,687,191 | 8/1987 | Stemmle . | |
| 4,871,158 | 10/1989 | May et al. . | |
| 4,925,171 | 5/1990 | Kramer et al. . | |
| 5,098,074 | 3/1992 | Mandel et al. . | |
| 5,169,142 | 12/1992 | Muck . | |
| 5,217,215 | 9/1991 | Ohata et al. | 270/53 |
| 5,290,020 | 3/1994 | Matsui et al. | 270/53 |

FOREIGN PATENT DOCUMENTS

| | | | |
|---|---|---|---|
| 0179756 | 9/1985 | Japan | 355/324 |
| 0254165 | 12/1985 | Japan | 355/324 |
| 0271369 | 10/1989 | Japan | 355/324 |
| 5-185766 | 7/1993 | Japan | 270/53 |
| 2173483A | 10/1986 | United Kingdom . | |

*Primary Examiner*—Edward K. Look
*Assistant Examiner*—John Ryznic
*Attorney, Agent, or Firm*—Lloyd F. Bean, II

[57] ABSTRACT

A finishing apparatus for receiving and attaching sets of sheet material in succession. A movable bin array including plurality of bins are provided for receiving the sheet in each individual bin. Rollers are provided for transporting a copy sheet to the finishing apparatus to one of each individual bin. Registration of the sheet is accomplished by the uphill nature of the each individual bin in the bin array sloping towards a registering portion of a gate assembly, and the action of a tamper mechanism registers the sheets. A stapling means having a cam that is radially urged moves in a plane substantially parallel to the orientation of the the bin array. The action of the cam drives the stapler means into a notched area of each individual bin positioned thereat so that registered sheet sets therein may be stapled in the notched area. The action of the stapler means also opens the gate on an adjacent bin so that a retaining gate on each individual bin are moved to an output of the way position enabling sheet sets therein to slide off each individual bin onto a guide support and into the output tray.

8 Claims, 4 Drawing Sheets

SORTER WITH STAPLER ACTIVED RELEASE GATE MECHANISM

FIELD OF THE INVENTION

The present invention relates to a sorter/finishing apparatus for a printing apparatus, and more particularly a sorter/finishing apparatus that incorporates a stapler capable of stapling a stack of sheets.

BACKGROUND OF THE INVENTION

The present invention is particularly suitable for an automatic copying machine wherein reproduction of multipage originals documents or sets are made by sequentially making the desired number of copies of a first page in the set, collecting the copies in individual trays or bins, sequentially making the desired number of copies of the second and subsequent pages of the set, and thereafter stapling the sets.

With the continue development of xerographic reproduction apparatus including those capable of operating at higher speeds it has become desirable to automatically process or handle the copies produced from the machine. The desire has been particular felt for obtaining fully collated and finished sets of copies from a collated original set of several pages. Means to provide a simple, relatively inexpensive, and accurate approach to stapling stacked sheets sets in a bin in such printing systems has been a goal in the design, manufacture and use of electrophotographic printers. This need has been particularly recognized in the mid-volume copying applications. The need to provide accurate and inexpensive stapling of stacked sheets sets in a bin has become more acute, as the demand for high quality, relatively inexpensive copies has increased.

Examples of prior automatic on-line collating copier finishers (staplers, stitchers, gluers or other binders) and/or offsetters and their controls are referenced in U.S. Pat. No. 4,782,363 to Britt et al., the disclosure of which is incorporated herein by reference.

A discussion of references that appear pertinent to the present invention follows:

- U.S. Pat. No. 4,376,529 Patentee: George et al. Issued: Marc. 15, 1983
- U.S. Pat. No. 4,558,860 Patentee: Stemmle Issued: Dec. 17, 1985
- U.S. Pat. No. 4,687,191 Patentee: Stemmle Issued: Aug. 18, 1987
- U.S. Pat. No. 4,925,171 Patentee: Kramer et al. Issued: May 15, 1990
- GB-2,173,483A Inventor: Stemmle Published: Oct. 15, 1986
- U.S. Pat. No. 4,497,478 Patentee: Reschenhofer et al. Issued: Feb. 5, 1985
- U.S. Pat. No. 4,605,211 Patentee: Sonobe Issued:Aug. 12, 1986
- U.S. Pat. No. 4,871,158 Patentee: May et al. Issued: Oct. 31, 1989
- U.S. Pat. No. 4,522,485 Patentee: Kamiya et al. Issued: Jun. 11, 1985
- U.S. Pat. No. 4,134,581 Patentee: Johnson et al. Issued: Jan. 16, 1979
- U.S. Pat. No. 5,098,074 Patentee: Mandel et al. Issued: Mar. 24, 1992
- U.S. Pat. No. 5,217,215 Patentee: Ohata et al. Issued: Jun. 8, 1993

The relevant portions of the foregoing disclosures may be briefly summarized as follows:

U.S. Pat. No. 4,376,529 discloses a finishing station for a reproducing machine including a generally vertical array of bins. Each of the bins is pivotally mounted on an elevator screw to provide bidirectional sorting of the copy sheets fed into the bins. A bin pivot motor drives a cam to a cam follower to pivot a bin through an arc to a stapling station. In the finishing operation, each of the bins is sequentially pivoted to the stapler station. A gripper mechanism is utilized to unload the stapled set into collecting bins.

U.S. Pat. No. 4,558,860 discloses a sorting apparatus which has a nest of a plurality of sheet receiving bins supported on a sorting support frame. Each bin has a sheet output end and a sheet input end. The plurality of bins are pivotally mounted at their output end about the same pivot point on the support frame such that the output end of each bin is at a level higher than its input end. A rotary shifting member sequentially pivots the bins about their pivoting mount to index the bins past the fixed feed throat for sheet insertion. As the bins are indexed past the fixed feed throat the rotary shifting member widely spaces adjacent bins to provide sheet entry for successive bins.

U.S. Pat. No. 4,687,191 discloses a sheet sorter of the nesting bin type. Translatable bins are driven so that there is an additional space between the bin immediately on top of a sheet entry location in any superposed bin, thereby providing access to a corner of a set of sheets registered in that bin. A stapler is reciprocal between a remote position permitting free indexing of the bins and an inner position in which it can be operated to staple the respective set of sheets together.

U.S. Pat. No. 4,925,171 discloses a sorter for sorting sheets fed from a sequential source of sheets. The sorter comprises a closely vertical spaced array of sorted bins. Also disclosed is an apparatus to vertically move the array of sorter bins relative to the source of sheets for sequentially loading individual sheets into the individual sorter bins. The system partially horizontally displaces the sorter bins to move one displaced bin at a time into the stapler for stapling the sheets sorted in that bin without removal therefrom. The partially horizontal displacement of the sorter bins is achieved by utilizing individual pins connected with respective individual sorter bins in a substantially vertically aligned array and an open jaw actuating system through which the array of pins is movable. The open jaw is adapted to engage and horizontally move a selected pin therein. An alternative cam track system with horizontal displacement transition therein is also disclosed for this function.

GB-2,173,483A discloses a sorter/stapler utilizing a tamper having a clamping mechanism for moving a set of sheets to a stapler and returning the stapled set to the bin.

U.S. Pat. No. 4,497,478 discloses an apparatus including a housing to be positioned adjacent a copy machine to receive copies from the machine. The apparatus squares the copies, staples them together and finally stacks them.

U.S. Pat. No. 4,605,211 discloses a sheet processing device adapted to be mounted to the sheet output portion of an image-forming apparatus. The device receives output sheets, automatically aligns them to one another, and then binds them in a bundle.

U.S. Pat. No. 4,871,158 discloses a finishing apparatus for binding copy sheets received in succession at a sheet compilation station. The compilation station is defined by a movable, horizontally arranged plate upon which sheets are collected, as well as stapling heads for two or more stapling apparatus. When the last sheet of a set to be stapled is collected, the place is quickly retracted from the set in timed sequence with the clamping of the stapling heads. Subsequently, the set is dropped onto a vertically movable tray.

U.S. Pat. No. 5,098,074 discloses a finishing apparatus for binding copy sheets received in succession on a movable compiling tray. The apparatus further includes a stapler into which copy sets are delivered and retracted for binding the compiling tray ultimately delivers the bond copy sets to stacking trays.

U.S. Pat. No. 5,217,215 discloses a sorter incorporating a stapler for sorting and stapling sheets discharged from an image forming apparatus. This sorter includes a plurality of vertically movable bins for storing the supplied sheets, a bin drive unit for conveying the bins, a pair of lateral guides, and a lateral guide drive unit for moving the lateral guides. The lateral guides are movable in the direction of the sheets in the bins and abut on both sides of stacks of the sheets to arrange them into widthwise adjustment, and then move them into stapling position of the stapler.

SUMMARY OF THE INVENTION

In accordance with the invention there is provided an apparatus for sorting and finishing sheets. The apparatus comprises a plurality of bins for holding sheets with each of the plurality of bins including an ejector gate. A stapler is provided and is adapted to move between an operative position for stapling sheets in one of said plurality of bins and an inoperative position remote from the sheets in the one of the plurality of bins. The ejector gate is actuated by the stapler moving between the operative position and inoperative position to eject sheets from one of the plurality of bins.

Another aspect with the invention there is provided a method for sorting and finishing sheets. The method comprising the steps of holding sheets in at least one of a plurality of bins with each the bins including an ejector gate. The step of moving a stapler between an operative position for stapling sheets in one of the bins and an inoperative position remote from the sheets in said one of the bins. And the step of actuating the ejector gate, in response to the step of moving the stapler, to eject stapled sheets from one the bins. These and other aspects of the invention will become apparent from the following description used to illustrate a preferred embodiment of the invention read in conjunction with the accompanying drawings.

While the present invention is described primarily in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 3:
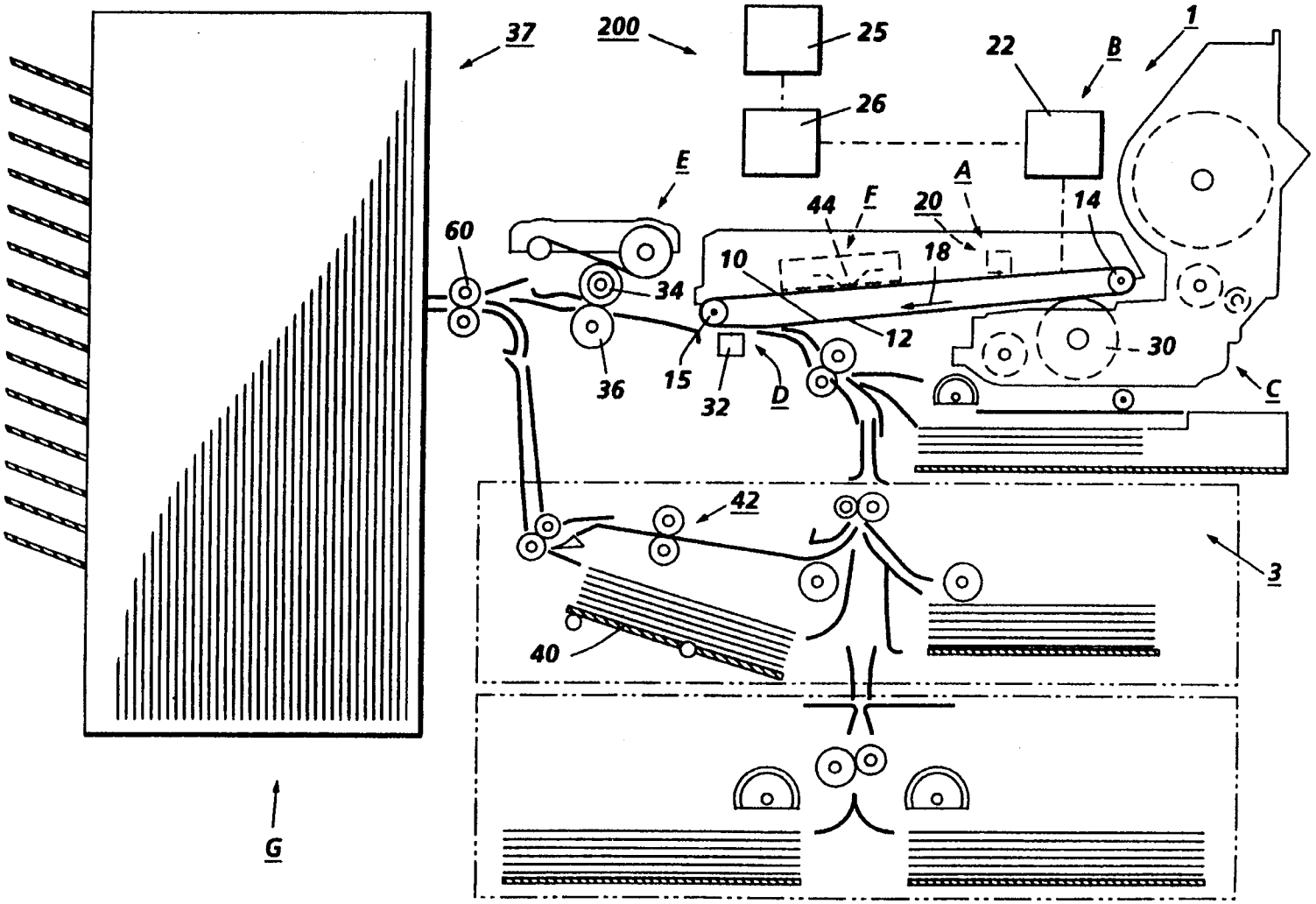
FIG. 3 is a fragmentary, elevational view illustrating various aspects or steps of the operation of the sorter/finishing apparatus.
Figure 4:
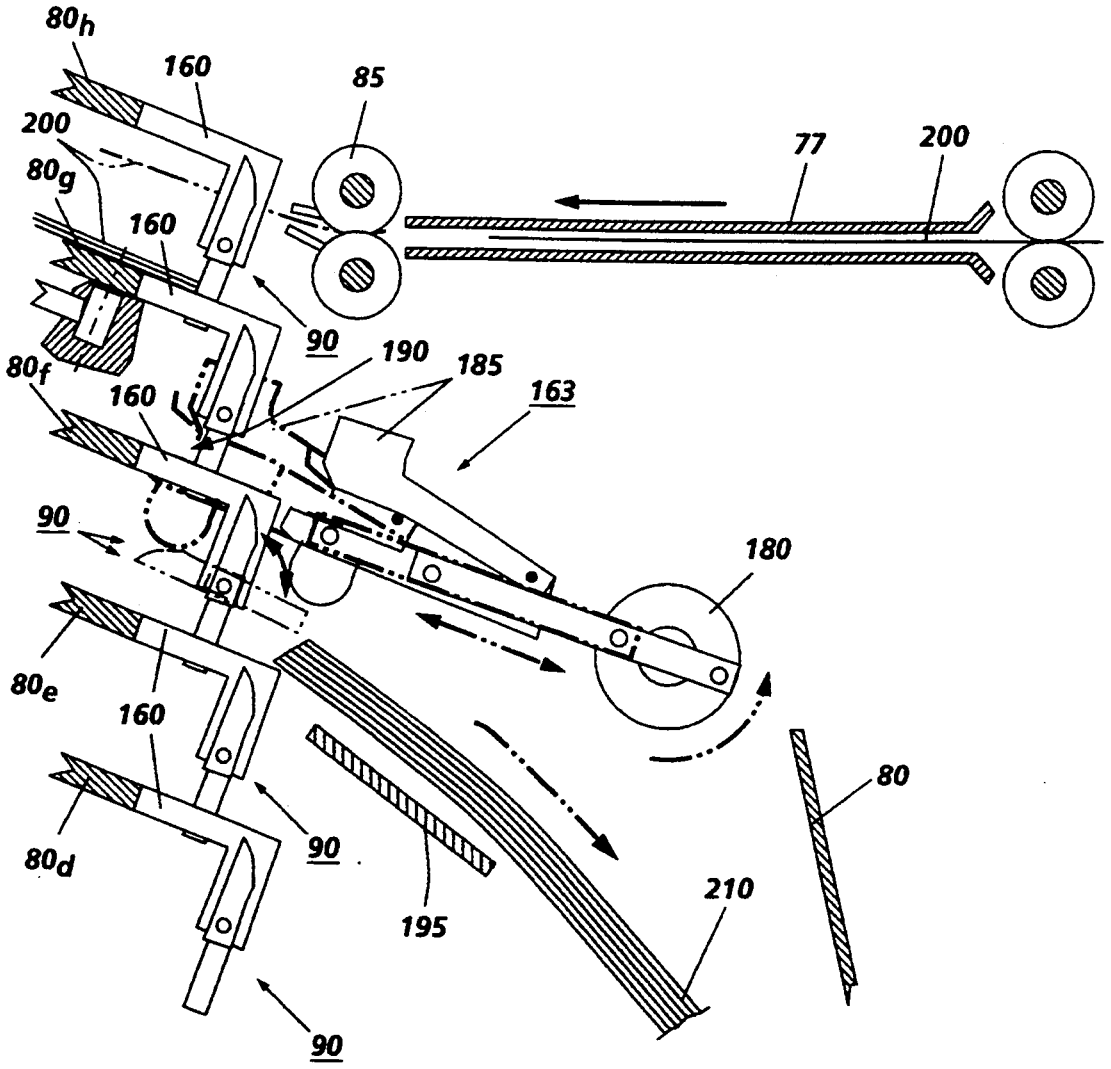
FIG. 4 is a schematic, elevational view depicting an illustrative electrophotographic printing machine incorporating the sorter/finishing apparatus of the present invention.

FIG. 4 schematically depicts an illustrative electrophotographic printing machine of the type in which the present invention may be employed. Specifically, the printing machine 1 of FIG. 3 has both a copy sheet transport system 3 for transporting sheets of material such as paper, mylar and the like, to and from processing stations of the machine 1. The machine 1, has conventional imaging processing stations associated therewith, including a charging station A, an imaging/exposing station B, a development station C, a transfer station D, a fusing station E, a cleaning station F and a finishing station G. The machine 1 has a photoconductive belt 10 with a photoconductive layer 12. The belt 10 is entrained about a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action the drive roller 14 to the imaging/exposing station B where a latent image is formed on the belt 10 by a light source 22. In this case, it is preferred that the light source is a raster output scanning device (a ROS) which is driven in response to signals from a data input terminal 25 which can be conventionally an input scanning device, a computer and the like. The signals from the data input terminal 25 are in this instance directed through a controller 26. It will also be understood that the terminal 25 and ROS 22 can be replaced with a light/lens-platen imaging station together with a document handling system (e.g., RDH).

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet transport system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray (not shown) through a finishing device 37 or along a selectable duplex path including apparatus for buffered duplexing and for immediate duplexing (i.e., tray 40 and path 42 in the case of the illustrative printing machine of FIG. 4). The portion of the belt 10 which bore the developed image is then transported to the cleaning station F where residual toner and charge on the belt is removed in a conventional manner by a blade edge 44 and a discharge lamp (not shown). The cycle is then repeated.

The foregoing description should be sufficient to illustrate the general operation of an electrophotographic printing machine. An electrophotographic printing apparatus is but one example of a wide variety of devices, which deliver cut sheets of material serially for collating into stapled sets, which may incorporate the sorting and finishing apparatus 37 of the present invention therein. As described, an electrophotographic printing system may take the form of any of several well known devices or systems. Variations in the specific electrophotographic processing subsystems or processes may be expected without affecting the operation of the present invention.

Figure 1:
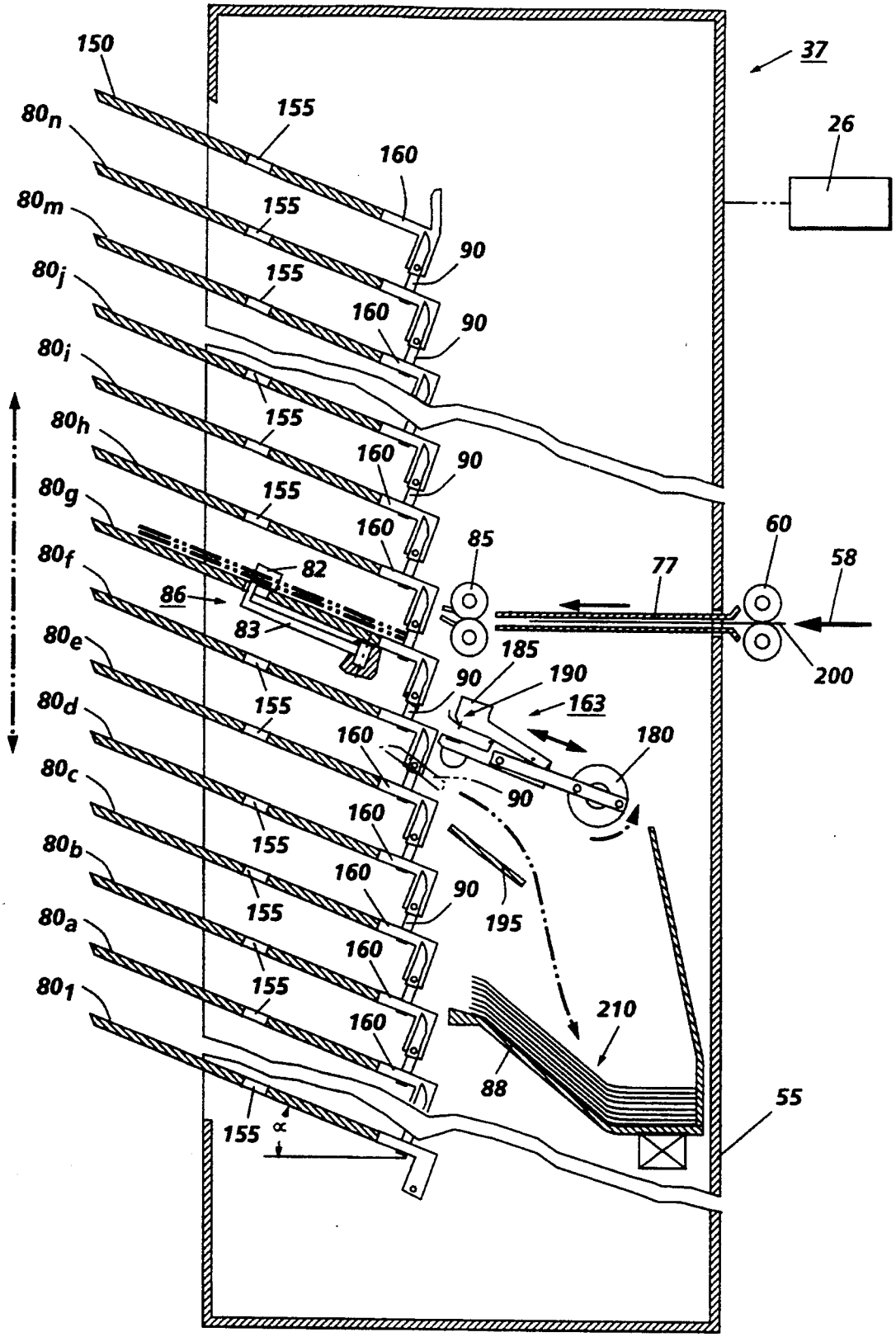
FIG. 1 is a schematic, fragmentary, elevational view of a sorter/finishing apparatus embodying the present invention.

The features of the present invention will now be discussed in greater detail with reference to FIG. 1 of the drawings. FIG. 1 depicts the output portion of an printing apparatus, which is preferably a conventional electrophotographic printing machine incorporating a plural tray finishing apparatus 37. It will become evident from the following discussion that the finishing apparatus 37 is equally well suited for use in a wide variety of printing apparatus, and is not necessarily limited in its application to the particular machine 1. The finishing apparatus 37 illustrated in FIG. 1 is shown as a modular unit having a housing 55. The housing 55 is detachably mounted to a printing apparatus (not shown in FIG. 1) by a conventional fastening arrangement (not shown). While the finishing apparatus 37 is described as a modular unit mountable to a printing apparatus by way of the housing 55, it is also contemplated that the finishing apparatus 37 could be constructed as an integral part of a printing apparatus 1.

The finishing apparatus 37 conventionally communicates with a printing apparatus (not shown in FIG. 1) by way of a transporting or copy sheet system. The copy sheet transport system includes a sheet path 58 in which rollers 60 are disposed. The rollers 60 are driven by a drive (not shown). The rollers 60 define a nip for transporting a copy sheet to a path 77 for directing sheets in the finishing apparatus 37 to one of the trays $\mathbf{80}_{1\text{-}N}$ disposed at the end of the path 77.

Thus, the paper path 77 feeds sheets to the movably stacking trays or shelves $\mathbf{80}_1$–$\mathbf{80}_N$, which are selectively positionable at an output of the path 77 where rollers 85 are positioned. It is preferred that the rollers 85 are corrugation rollers to facilitate the transport of the copy sheets therefrom into the shelves $\mathbf{80}_{1\text{-}N}$. The shelves $\mathbf{80}_{1\text{-}N}$ are mounted to the housing 55 by a conventional elevator assembly (not shown) connected so as to operatively and effectively shift the position of the shelves $\mathbf{80}_{1\text{-}N}$ with respect to the path 77. Each of the shelves $\mathbf{80}_{1\text{-}N}$ is slanted so that each extends in a transverse direction relative to the horizontal, at an angle alpha (as shown in FIG. 1), to facilitate the stacking of individual copy sheets, sets of copy sheets, and the ejection thereof into output tray 88. The shelves $\mathbf{80}_{1\text{-}N}$ are typically rectangular or square platforms.

The operation of elevator (not shown) as well as the drive mentioned above, a stapler assembly to be described below are controlled programmably by a controller 26. Some examples of control systems, such as the control system used to implement the controller 26, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. It is well known in general and preferable to program and execute control functions and logic, such as those executed by the controller 26, with conventional software instructions for conventional microprocessors. This is taught by the above and other patents and various commercial copiers. Such software may, of course, vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, control of exemplary document and copy sheet transport systems in printing machines, including copiers, may also be accomplished by such controller.

An optional or desirable feature, the control and operation of finisher that employ multi-bin sheet collators or sorters to use or group more than one adjacent bin when the number of sheets in a copy set will exceed the capacity of a single bin is known, for example, from U.S. Pat. No. 4,522,485, the immediately above-cited Takahashi et al. U.S. Pat. No. 4,501,419, or U.S. Pat. No. 4,134,581, and various above and other references. There were also commercially available for many years sorters in which bins were addressable by punched card or paper tape controls. Said U.S. Pat. No. 4,501,419 is also of interest as showing individual pivotal bin gates, which gates also have another surface normally providing a "ski" or baffle for holding sheets against the sorter transport belt as they move past the array of bins until they reach the selected bin (see especially FIG. 3 thereof).

When a sorter unit is to be alternatively used for, or converted to use for, a printer mailbox unit, it may be desirable to increase the available sheet stacking space between bin trays or shelves to increase bin capacity. Moving or removing sorter bin shelves for doubling or tripling the number of multiple copies which a particular bin can receive is taught for a sorter per se in U.S. Pat. No. 3,907,279 issued Sep. 23, 1975 to J. H. Erwin by AM Corp. (See especially Col. 3.) Doing so for different numbers of copies or documents to different users in preprogrammed bin sequences is suggested in Col. 1.

Figure 2:
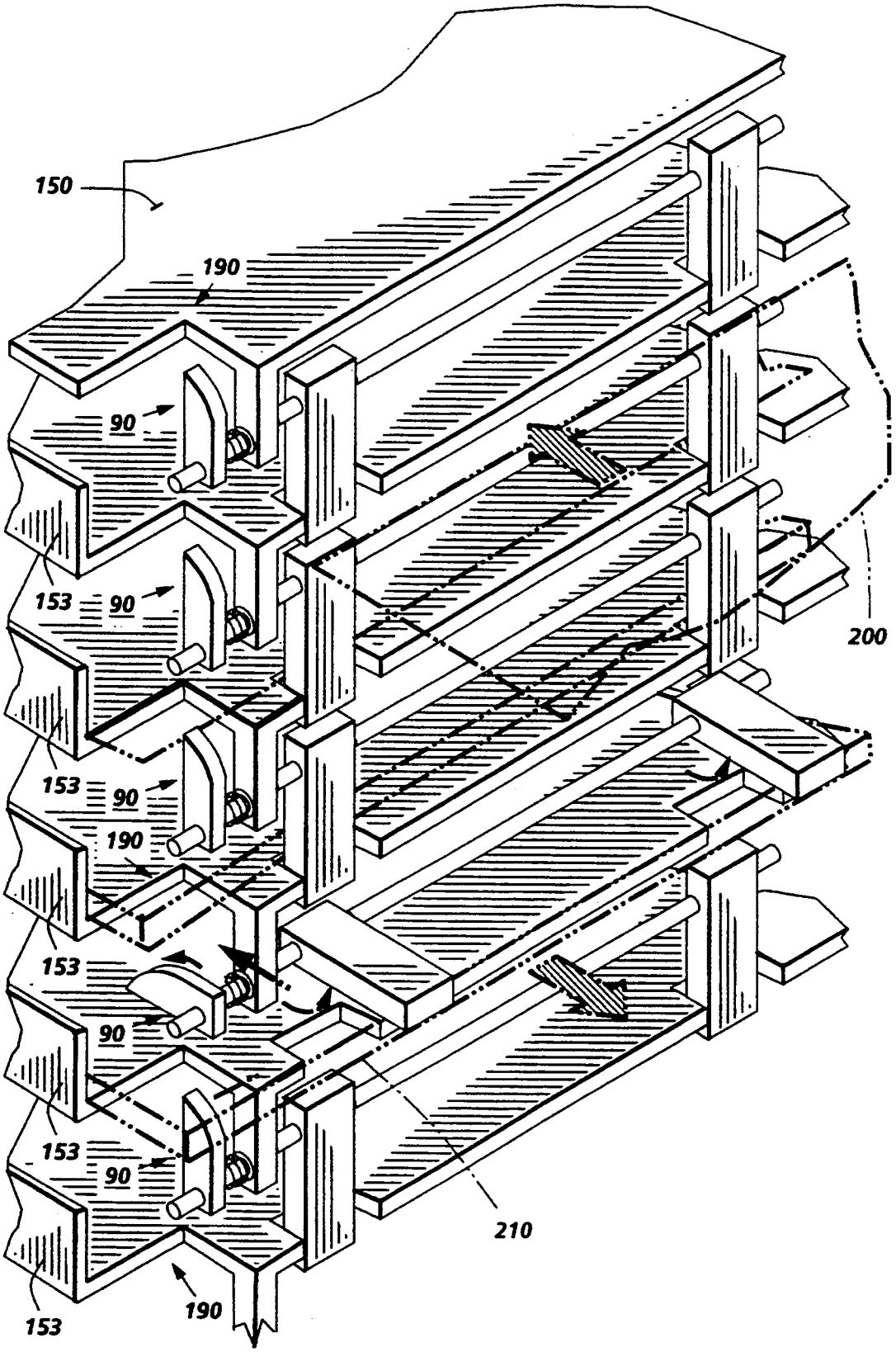
FIG. 2 is a fragmentary, elevational view illustrating various aspects or steps of the operation of the sorter/finishing apparatus.

Referring to FIG. 1 and FIG. 2, the compiling shelves $\mathbf{80}_{1\text{-}N}$ define or are operatively associated with, a registration arrangement including at least one abutment finger or tamper mechanism 86, a side plate and an assembly gate 90. The side plate 153 being immediately adjacent to a side edge of each compiling shelf 80. In the illustrated embodiment of FIG. 2, the side plate 153 is connected to each compiling shelf 80, but in other embodiments, the side plate 153 could be integrally formed with a wall of the housing 55. The gate assembly 90 and the side plate 153 of each shelf form a registration corner, the significance of which corner will be discussed in further detail below.

Turning to the specific subject matter of the present invention, with reference to the FIG. 1 and FIG. 2, there is illustrated the sorting and finishing apparatus, hereinafter referred to as the sorter 37, of the present invention. The sorter 37 is adapted for use with a device, such as an electrophotographic printing machines, which delivers cut sheets of material serially for collating into stapled sets. The sorter 37 comprises the array $80_{1-N}$ of shelves with each bin having a suitable means for urging a set of copy sheets therein to a registered position against the lateral edges of the side plate 153 and the forward edge of the bin and against gate 90.

In the illustrative example of FIG. 1 and FIG. 2, the suitable urging means comprises the tamper apparatus 86 mounted, in this case, to act upon sheets in one of the shelves at a time. In the illustrative examples, the array of shelves $80_{1-N}$ are generally vertically arranged extending bins deposed at an angle alpha but the array 80 and the bins $80_{1-N}$ thereof may be positioned or disposed as desired to function efficiently in combination with a selected device which delivers cut sheets of material serially for collating into stapled sets. The plurality of bins $80_{1-N}$ are arranged in a nest-like configuration wherein the bins $80_{1-N}$ are positioned one on top of another.

With specific reference to FIG. 1, there is illustrated a portion of the array of shelves 80. One form of operation of the shelves and the indexing suitable for use with the present invention is generally described in detail in U.S. Pat. No. 4,558,860 to Stemmle which is herein incorporated by reference. Other well known movement and operating protocols may be employed with the present invention.

Although the shelves $80_{1-N}$ are generally horizontally extending, although at the previously referenced angle alpha so that the input/output end of each of the bins $80_{1-N}$ are at a level lower than the opposite end at the manual output area 150 and the sheet set output area 160. Thus, areas of the shelves $80_{1-N}$, at least at these areas, slope downwardly toward the output tray 88 for depositing sheets therein into the output tray 88 and toward the output of sheet path 77 for feeding sheets into the shelves. This arrangement provides for uphill feeding of individual sheets into the shelves $80_{1-N}$ as they are positioned at the output of sheet path 77 over the gates 90. In this manner, sheets arranged may be stack and and registered as they are inserted in each of the shelves $80_{1-N}$. Registration is accomplished by the downhill nature of the shelves extending the downwardly registering portion (not shown) of gate assembly 90, and the action of tamper mechanism 86. Thus, once inserted in the uphill orientation, individual sheets in the shelves $80_{1-N}$ will readily fall back by the force of gravity aided by action of the tamper mechanism 86 to overcome any frictional engagement between sheets and/or the surface the shelves to register the trailing edge thereof against a back stop portion (not shown) of the gate 90. In addition, the sheet tamping mechanism tamps each newly loaded sheet against an upstanding lip or the side plate 153 in each of the shelves $80_{1-N}$. It will be understood that the side plate 153 extends generally perpendicular to the registering portion of each of the gates 90 to provide registration edges for registering sheets in the shelves $80_{1-N}$ along adjacent edges of such sheets.

Referring further to FIG. 1, the illustrative tamping mechanism 86 comprises a bar 83 (it is preferred that it be displaced at the angle alpha as such bins) having an abutting member 82 extending perpendicular to the bar 83 at the distal end of the bar. The height of the abutting member 82 need not be smaller than the spacing between bins, as it is known to place a cut out area 155 in each of the shelves $80_{1-N}$ so that the movement of the bar 83 is not inhibited by the shelves $80_{1-N}$ which are in the substantially vertically aligned array. A suitable driving means, such as, for example, a motor connected by a belt and pulley arrangement or other suitable means, provides horizontal displacement of the tamping mechanism 86. The displacement of the mechanism 86 urges or tamps the sheets against the side plate 153 (see FIG. 2) of the shelves $80_{1-N}$ as the shelves are moved relative to the mechanism 86.

For example, the bar 83 is preferably mounted to move in a plane aligned with the shelves $80_{1-N}$ on which it acts. Thus, the abutting member moves into and out of engagement with sheets in the shelves. This movement can be accomplished through waives known means including, for example, a cam with bar 83 acting as a cam follower to displace the distal end of the bar. Additionally, in such cases, it is preferred that the bar 83 be spring biased, preferably at the distal end thereof, by a spring mechanism (not shown) in the direction of the cam (not shown) to maintain contact therewith. Solenoid actuated arms and/or levers, cylinders, biasing mechanisms, gears and/or other mechanical devices may be employed to provide the generally lateral displacement of the tamping mechanism 86 (i.e., to permit the abutting member to move lateral in the cut out portion of a shelve 80 positioned thereat to provide registration of different paper sizes or orientations).

Regardless of the mechanism and the arrangement employed, the tamping mechanism 86 is displaced in a horizontal plane at the sheet receiving elevation of each of the shelves $80_{1-N}$ during the sorting operation. The tamping mechanism 86 is displaced preferably concurrent or immediately subsequent to the receipt of a sheet in a bin but certainly prior to any stapling thereof. The perpendicularly extending abutting member 82 contacts the side edge of the sheet and urges the sheet tamping it against the side plate 153, of the shelve position thereat (in FIG. 1 shelf **80*g*). A sensor (not shown) could be positioned in a suitable location along the path of movement of the sheet, such as adjacent the sorter input rolls or within the respective shelves 80, to determine when the sheet has entered a shelf. The sensor could be a charged coupled device comprising a light emitter and light receiver which can detect the presence of a sheet at a particular location in the path of the sheet by detecting the interruption by the sheet of the light beam between an emitter and receiver pair. A variety of other suitable sensors are well known in the art and can be utilized as well. The microprocessor controller 26 upon receiving a signal indicative that the sheet has entered the bin would generate a signal to the driving means to initiate the horizontal movement of the tamping mechanism 86. In this fashion, the tamping mechanism 86 can register each sheet collated in the respective shelves $80_{1-N}$ against the side plate 153 and the gate 90**.

If desired, the sorter 37 can be used to operate in a unidirectional manner (e.g., for use with precollating printing machines), or it can be operated in a bidirectional manner, sorting sheets as the individual bins are indexed both upward and downward. In any event, as the last sheet of each copy run is placed in a shelf (e.g., shelf **80*g*), the shelves would be waxed downward thereby enabling the first copy (in precollative operation) of the next collated set, or the last page in the next collated set (in post-collation devices) to be loaded in the adjacent shelf 80*h***. (It will be understood that the described operation assumes the controller has arranged the loading of sheets so that the last sheet of a set is loaded on a downward indexing.) To achieve the downward indexing required for bidirectional indexing, the motor may include a clutch, bi-directional motor (or other means) for driving the mechanism in opposite directions. It will be understood that even the unilateral indexing system will require bidirectional movement for the following jobs.

The device could also be designed with stationary or "fixed" bins, and the input nip 85, stapling means 163, and stacking tray 88 could be mounted on a vertically moving carriage. The stapling and set ejection functions would still operate as described below.

Once the sheets are discharged into and compiled in shelves 80 (in this example 8*j*) and indexing is downward toward the stapling station, the stapling operation can begin. In the stapling operation, the indexing mechanism positions one of the shelves $\mathbf{80}_{1\text{-}N}$ at the proper elevation to be aligned with a stapler means 163 in the same fashion as the indexing mechanism positions the shelves $\mathbf{80}_{1\text{-}N}$ in alignment to receive the sheets from the during the sorting operation. When an individual shelves $\mathbf{80}_{1\text{-}N}$ is positioned in alignment with the stapling means, the stapler means 163 is actuated toward an individual bin which is generally to position the set of copy sheets from the bin into position to be stapled by the stapling means 163(FIG. 4).

The stapling means 163 includes a linkage or cam 180 which is radially urged by a drive motor (not shown) to drive a base plate 185, which moves in a plane substantially parallel to the orientation of the shelves $\mathbf{80}_{1\text{-}N}$. The staple is secured to the base plate so that the action of the cam drives the stapler means 163 into a notched area 190 of the shelf 80 positioned thereat so that registered sheet sets therein may be stapled in the notched area 190.

The action of the stapler apparatus also opens the gate 90 so that the retaining lips are moved to an output position enabling sheet sets therein to be advance off the shelf 80 by a advancing means onto a guide support 195 and into the output tray 88. It is desirable use incline of the shelf at an angle alpha and use the aid of gravity as the advancing means to advance the sheet sets off the shelf. However, it should be evident that other well know advancing means could be employed, such as a urging roller or a conveyor.

The generally horizontal displacement or collating of each of the sets of copy sheets within the output tray 88 can be accomplished using a suitable urging means such as known sliding mechanism to move the output tray 88 laterally within respect to the bins 80. Thus, enabling stapling, stacking and offset to be disposed in the output tray 88.

To resummarize the operating steps, rollers 60 define a nip for transporting a copy sheet 200 (as shown in FIGS. 2 and 3) to a path 77 for directing sheets in the finishing apparatus 37 to one of the trays $\mathbf{80}_{1\text{-}N}$ disposed at the end of the path 77. The paper path 77 feeds sheets to the movably stacking trays or shelves $\mathbf{80}_1\text{–}\mathbf{80}_N$, which are selectively positionable at an output of the path 77. Registration of the sheet is accomplished by the downhill nature of the shelves extending the downwardly registering portion (not shown) of gate assembly 90, and the action of tamper mechanism 86. Thus, once inserted in the uphill orientation, individual sheets in the shelves $\mathbf{80}_{1\text{-}N}$ will readily fall back by the force of gravity aided by action of the tamper mechanism 86 to overcome any frictional engagement between sheets and/or the surface the shelves to register the trailing edge thereof against a back stop portion (not shown) of the gate 90. A stapling means 163 which includes a linkage or cam 180 that is radially urged by a drive motor (not shown) to drive a base plate 185, which moves in a plane substantially parallel to the orientation of the shelves $\mathbf{80}_{1\text{-}N}$. The action of the cam drives the stapler means 163 into a notched area 190 of the shelf 80 positioned thereat so that registered sheet sets therein may be stapled in the notched area 190. The action of the stapler means 163 also opens the gate 90 so that the retaining lips are moved to an output of the way position enabling sheet set 210 (as shown in FIGS. 2 and 3) therein to slide off the shelf 80 onto a guide support 195 and into the output tray 88.

It is, therefore, apparent that there has been provided in accordance with the present invention, a sorting and finishing apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for sorting and finishing sheets, comprising:

a plurality of bins for holding sheets with each of said plurality of bins including an ejector gate; and a stapler adapted to move between an operative position for stapling sheets in one of said plurality of bins and an inoperative position remote from the sheets in said one of said plurality of bins, said ejector gate being actuated by said stapler moving between the operative position and inoperative position to eject sheets from said one of said plurality of bins.

2. The apparatus according to claim 1, further comprising a camming means, associated with said stapler, for actuating said ejector gate to eject stapled sheets from said one of said plurality of bins in response to said stapler moving between the operative position and inoperative position.

3. The apparatus according to claim 2, further comprising:

indexing means, adapted to move said plurality of bins, for sequentially loading individual sheets being fed into each of said plurality of bins;

an output tray for holding sheets; and means for advancing stapled sheets from said one of said plurality of bins to said output tray in response to said ejector gate being actuated.

4. The apparatus according to claim 2, wherein said camming means actuates said ejector gate in response to said stapler stapling the sheets in said one of said plurality of bins to discharge stapled sheets therefrom, said ejector gate preventing unstapled sheets from being discharged from said one of said plurality of bins.

5. The apparatus according to claim 3, wherein each of said plurality of bins includes a tray and a sheet registration guide along a side said tray for aligning the sheets in each of said plurality of bins.

6. The apparatus according to claim 2, wherein each of said plurality of bins comprises a tray positioned on an incline so that stapled sheets slide downwardly under the influence of gravity to exit therefrom.

7. A method for sorting and finishing sheets, comprising the steps of:

holding sheets in at least one of a plurality of bins with each the bins including an ejector gate;

moving a stapler between an operative position for stapling sheets in one of the bins and an inoperative position remote from the sheets in said one of the bins; and actuating the ejector gate, in response to said moving step, to eject stapled sheets from one the bins.

8. A method according to claim 7, further comprising the steps of:

indexing said plurality of bins;

loading sequentially individual sheets into the bins;

energizing the stapler to staple sheets in the bin in response to said actuating step with said actuating step being inhibited in response to the stapler being de-energized.

* * * * *